US005225611A

United States Patent [19]

Scott

[11] Patent Number: 5,225,611

[45] Date of Patent: Jul. 6, 1993

[54] OVER/UNDER SHOTGUN SAFETY ARM

[76] Inventor: Alvin E. Scott, 201 Sierra Rd., Kerrville, Tex. 78028

[21] Appl. No.: 733,146

[22] Filed: Jul. 19, 1991

[51] Int. Cl.[5] ..... F41A 19/14

[52] U.S. Cl. ..... 42/42.03; 42/70.08

[58] Field of Search ..... 42/41, 42.01, 42.03, 42/43, 42.02, 70.08, 65, 63

[56] References Cited

U.S. PATENT DOCUMENTS

| | | | |
|---|---|---|---|
| 9,922 | 8/1853 | Leonard | 42/65 |
| 21,054 | 7/1858 | Raymond et al. | 42/65 |
| 21,188 | 8/1858 | Elliot | 42/65 |
| 239,496 | 3/1881 | Heeren | 42/70.08 |
| 485,043 | 10/1892 | Jonson | 42/41 |
| 698,194 | 4/1902 | Gates | 42/41 |
| 1,900,608 | 3/1933 | Lester | 42/42.01 |
| 4,141,165 | 2/1979 | Dichter et al. | 42/65 |
| 4,213,263 | 7/1980 | Brouthers | 42/65 |
| 4,345,397 | 8/1982 | Hartman | 42/42.02 |
| 4,625,443 | 12/1986 | Beretta | 42/42.03 |
| 4,744,166 | 5/1988 | Mattarelli | 42/41 |

FOREIGN PATENT DOCUMENTS

| | | | |
|---|---|---|---|
| 19241 | 3/1956 | Fed. Rep. of Germany | 42/41 |
| 453502 | 12/1949 | Italy | 42/41 |

*Primary Examiner*—Michael J. Carone

*Attorney, Agent, or Firm*—William J. Beard

[57] ABSTRACT

A double action safety lock mechanism is disclosed for use in a two barrel firearm. Fixed firing pins on a frame member are struck by a pivotally mounted hammer carried on a pivotally movable trigger plate member and engaging a sear member attached to the frame member. Extra security and safety is provided by a key controlled locking system capable of rendering the entire firearm lock immobile. Means are also provided for selectively firing only one of the two barrels of the arm at a time.

13 Claims, 3 Drawing Sheets

FIG. 2
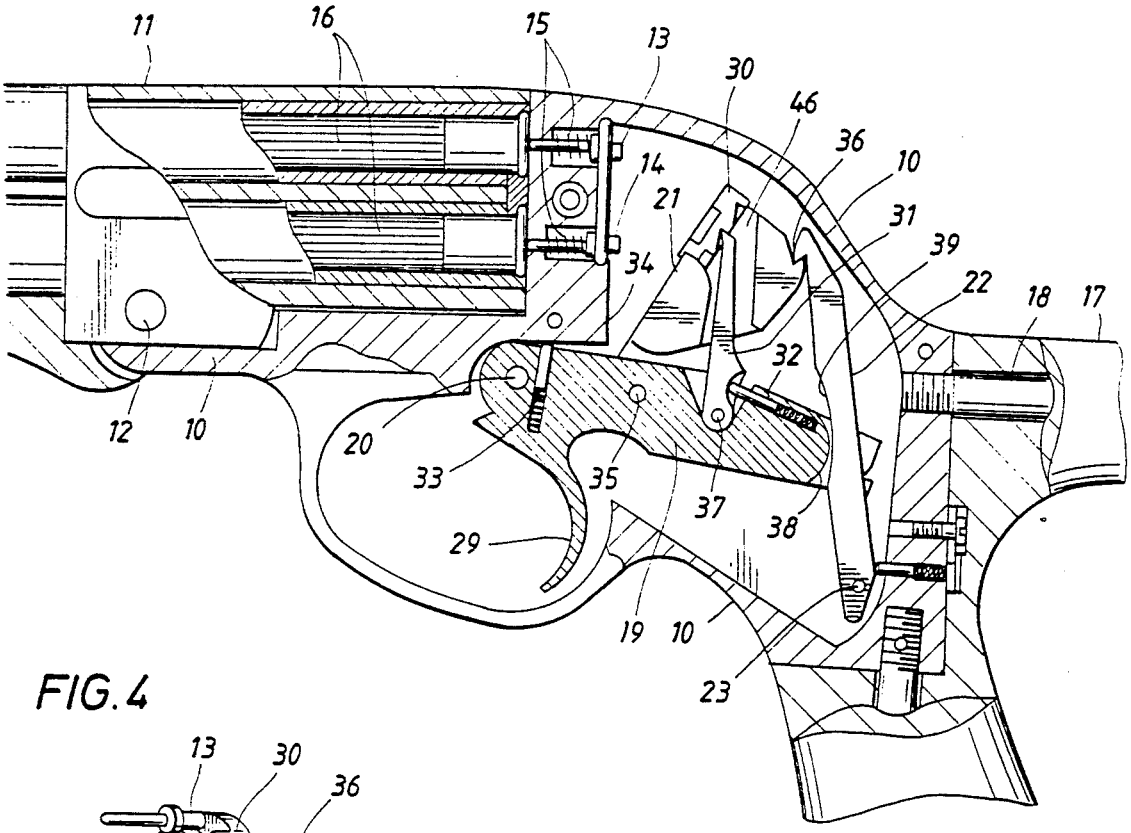
FIG. 4
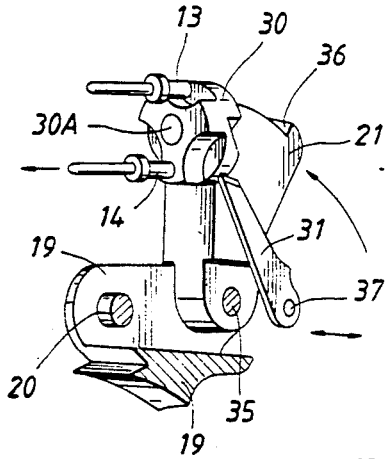
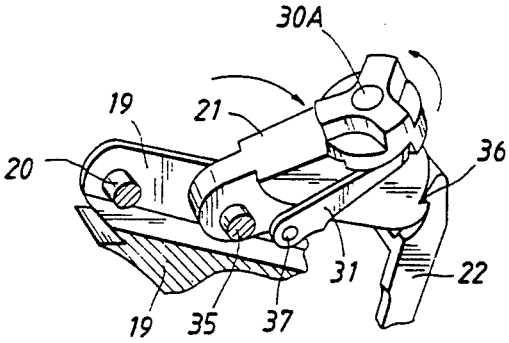
FIG. 5
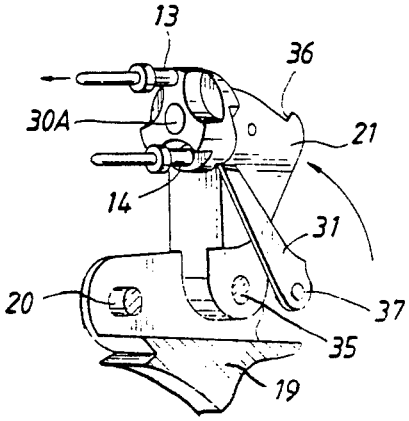
FIG. 6

FIG. 7
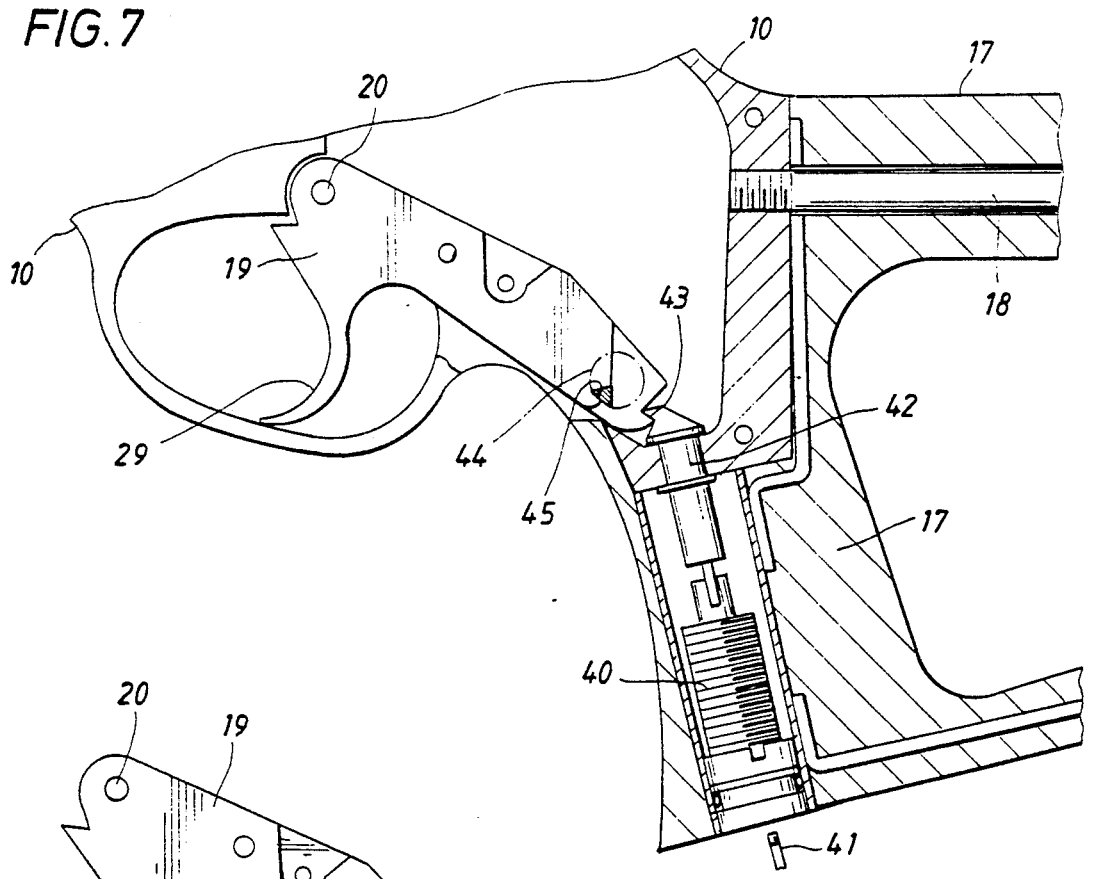
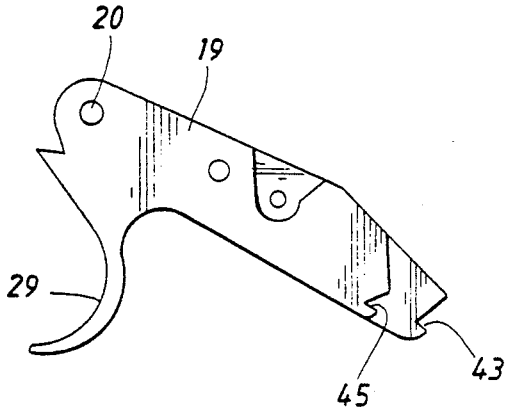
FIG. 8
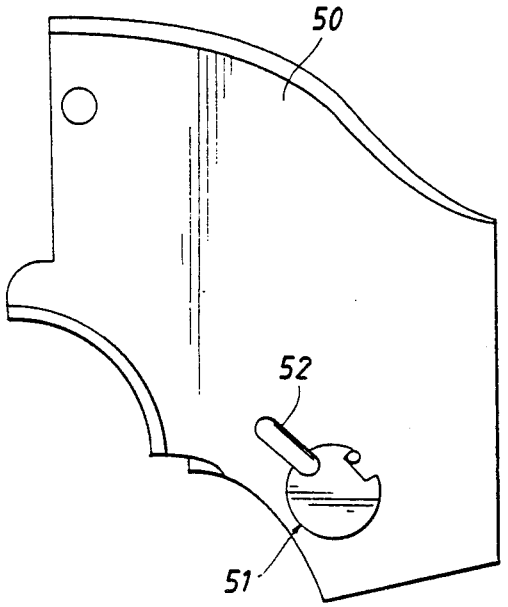
FIG. 9
FIG. 10A
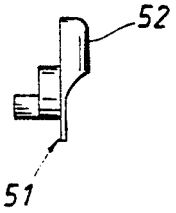
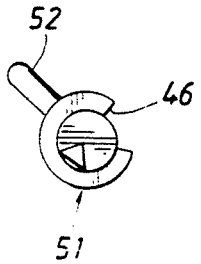
FIG. 10B

OVER/UNDER SHOTGUN SAFETY ARM

BACKGROUND OF THE INVENTION

This invention relates to firearms, and more particularly, to firearms locks of the double action type.

Traditionally breech loading over under shotguns or rifles, or side by side shotguns or rifles, have employed locks of the single action type. In a single action type lock in a firearm three basic components are provided, a trigger which engages a sear, a sear which engages a hammer or striker and a hammer or striker which supplies the kinetic energy of motion to set off the primer in a round of ammunition by impacting it. In the single action system as employed in prior art two barrel guns of the shotgun or rifle variety usually each barrel has a separate lock mechanism. That is to say one lock system of trigger, sear, and striker or hammer fires one gun barrel and the opposite gun barrel is fired by a separate trigger, sear, and hammer or striker. Occasionally one of the triggers, hammers or sears is eliminated from a particular design. Also, in the single action system separate physical actions are required for "cocking" the hammer or striker and for releasing the hammer or striker. The "cocking" or setting of the hammer in stressed, or potential energy, configuration is usually performed in modern guns by opening the gun barrels as a cocking lever and to extract previously fired ammunition and to insert new ammunition. In older guns the cocking function was performed manually upon externally exposed hammers simply by "thumbing" them back or finger cocking them.

Once the single action lock hammer is cocked it is held in place by the sear and is ready to fire by only the exertion of the slightest pressure by the trigger onto the sear, thus dislodging the sear from its holding engagement with the hammer. To carry such a gun safely when cocked, requires in the strictest sense a safety mechanism which locks the hammer and the sear to immobility. This has, in the prior art, been provided by various mechanisms, such as interceptor bars interposed between trigger and sear, or between hammer and cartridge or between sear and hammer in a variety of fashions. Even so, such guns could be often "jarred off" by sudden acceleration as by dropping the gun and jarring the safety off or the hammer from engagement with the sear.

In a double action mechanism of the type contemplated in the present invention however, a much higher degree of safety from accidental discharge is provided. A single trigger pull in the system of the present invention both cocks the hammer, releases the sear from the hammer and selects which barrel of the two barrel gun is to be fired. If the trigger is released in mid motion of its travel, or at any time prior to actual sear disengagement, the gun is immediately returned to a safe position where the hammer or striker mechanism is prohibited from contact with the cartridge primer. Thus the full double action system of the firearm according to the present invention is much safer than any single action system from accidental "jarring off".

Moreover, the safety firearm system of the present invention is provided with manually activated safety and also provides a key lock system for completely disabling the firearm by preventing any motion of the lock mechanism at all. A coded key is required to release this mechanism in order to enable any lock component motion.

BRIEF DESCRIPTION OF THE INVENTION

Briefly, the double action lock firearm safety system of the present invention may be employed in two barrel (side by side or over/under) guns. In the double action system of the invention a frame is provided on which the guns" barrels are hinged. A separate firing pin for each barrel which is permanently mounted in the frame at the breech end of the barrels in their closed position and aligned with the primer of a cartridge inserted into each barrel. A trigger plate is mounted pivotally to the frame and a hammer or striker is mounted pivotally to the trigger plate. A sear is mounted pivotally to the frame in a manner such that it can engage a sear notch in the hammer or striker.

When the mechanism is in a "rest" position the hammer is uncocked and mechanically out of alignment with either of the frame mounted firing pins. As the trigger plate begins its pivotal motion supplied by finger pressure on a trigger lever, the sear engages the hammer. Continued pivotal motion starts compression of a hammer spring. The hammer also starts an arcuate upward motion relative to the frame to bring it into alignment with the firing pins. As pivotal trigger plate motion continues, the hammer is brought to full cock (ie. fully compressed spring) and into alignment with the firing pins. Simultaneously, a cam surface on the trigger plate engages a cam surface on the sear and starts a rearward pivotal motion of the sear to disengage it from the hammer/sear notch. At the peak of its arcuate pivotal motion the trigger plate brings the hammer into alignment with the firing pins and the cam surface on the trigger plate causes disengagement of the sear, releasing the now fully cocked hammer to begin its forward motion to strike a firing pin and set off a cartridge.

The firearm safety system of the present invention may best be understood by reference to the detailed description to follow when taken in conjunction with the attached drawings.

It will be understood that these drawings are intended to be illustrative only and not limitative as the concepts of the invention may extend to other embodiments of the invention than shown herein.

BRIEF DESCRIPTION OF THE DRAWINGS

FIG. 2 is a schematic view showing the barrel closed, half motion position of the trigger in the firearm lock system of the invention.

FIG. 4 shows one position of the barrel selection mechanism.

FIG. 5 shows a second position in the motion of the barrel selection mechanism.

FIG. 6 shows a third position of the barrel selection mechanism.

FIG. 7 schematically shows a safety key lock system for disabling the lock mechanism of the firearm of the present invention completely.

FIG. 8 schematically shows a side view of the trigger plate member.

FIG. 9 schematically shows the side plate cover of the firearm.

FIGS. 10*a* and 10*b* show the manual safety lever in side and end views.

DETAILED DESCRIPTION OF THE INVENTION

Figure 1:
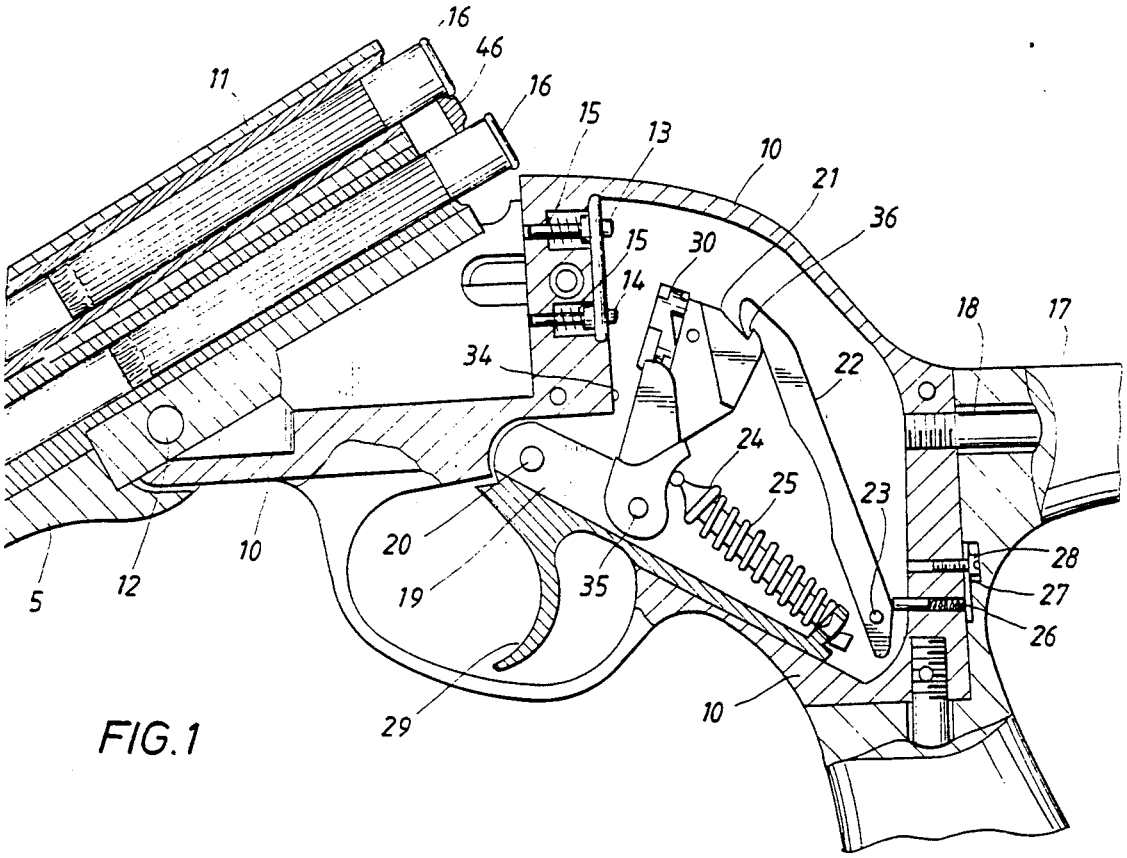
FIG. 1 shows the lock portion and barrels of a firearm employing concepts of the present invention in the barrel open, rest position, schematically.

Referring initially to FIG. 1 a double action lock system, side view with cover plate off, is shown schematically and partially in section. A frame member 10 has over/under barrels 11 pivotally mounted thereon at hinge pin 12. The barrels 11 are retained in a conventional manner by a forend piece 5 as known in the art. Shown inserted in firing chambers in barrel 11 are cartridges 16 which are shown in an elevated position for easy removal, held there by an extractor 46 in a conventional manner known in the art.

The frame member 10 has two bores therethrouqh in axial alignment with the bores of barrels 11 when the barrels 11 are closed. These bores carry firing pins 13 and 14 which are sized for a slidable fit therein and are biased away from the barrels 11 bores by springs 15 as shown. Firing pins 13 and 14 have sufficient length so that when struck on their base end they will protrude into the bores of barrels 11 and engage the primer portion of cartridges 16 thereby firing the cartridges.

The frame member 10 is provided with a stock (buttstock or pistol grip shaped as desired) member 17 which is retained thereto by a through bolt 18 threaded to frame member 10 as shown. Pivotally mounted to frame 10 on a pin 20 is a trigger plate member 19. A hammer or striker member 21 is pivotally mounted on a pin 35 to trigger plate member 19. Hammer 21 is provided on its striking face with a rotatably mounted striking disk 30 which will be discussed in more detail later The hammer 21 is spring biased toward frame member 10 by a plunger guide 24 and coil spring 25 as shown.

Frame member 10 also supports a sear member 22 pivotally mounted on a pin 23 secured to frame member 10. The sear 22 is spring biased to the left by plunger and spring 26 which is retained in its bore in frame 10 by a retaining plate 27 held in place by a screw 28 threaded to the frame 10. The sear 22 and hammer 21 are each provided with cooperatively shaped engaging surfaces 36 as shown referred to herein as the hammer/sear interface.

Referring now to FIG. 2 the trigger plate member 19 is also provided with a hand or pawl 31 pivotally mounted on a pin 37 affixed to trigger plate 19. The hand or pawl 31 travels in a groove 46 machined in the side of hammer 21. The hand or pawl 31 engages a tooth on the rear surface of the striking disk 30 as shown. Pawl or hand 31 is biased forward by plunger and spring combination 32 as shown.

In FIG. 2 finger pressure applied to trigger plate 19 via a trigger lever 29 has moved the entire trigger plate 19 pivotally about pin 20 from the position shown in FIG. 1. The position shown in FIG. 2 may be referred to as the half pull position. The sear 22 has engaged the hammer 21 at hammer sear interface 36 and as the hammer 21 is being raised or elevated by this trigger plate motion has held the hammer 21 back and begun to compress hammer spring 25 (FIG. 1). Thus potential energy is stored in the spring 25 by this pivotal motion of trigger plate 19.

A cam surface 38 on trigger plate 19 has begun to engage a cam surface 39 on sear 22 in the half pull position of FIG. 2. The engagement of cam surfaces 38 and 39 starts a pivotal motion of sear 22 away from hammer 21 about the pivot point 23 of sear 22.

It is important to note at this point that in the position shown in FIG. 2 that only finger pressure on trigger lever 29 holds trigger plate 19, hammer 21 and sear 22 in their relative positions. If this pressure is released, all of these components will because of spring actions return to the "rest" position shown in FIG. 1. From a safety standpoint it is also important to note that in FIGS. 1 and 2 that if the sear hammer engagement 36 were somehow "jarred" loose by a violent blow, that hammer 21 is too low relative to frame member 10 to reach firing pins 13 and 14. Also a shoulder 34 in frame member 10 would intercept forward travel of hammer 21 further preventing it from striking firing pins 13 and 14. Thus while the trigger plate 19 is in the positions shown in FIGS. 1 and 2 it is mechanically impossible for hammer 21 to strike the firing pins 13 and 14.

Figure 3:
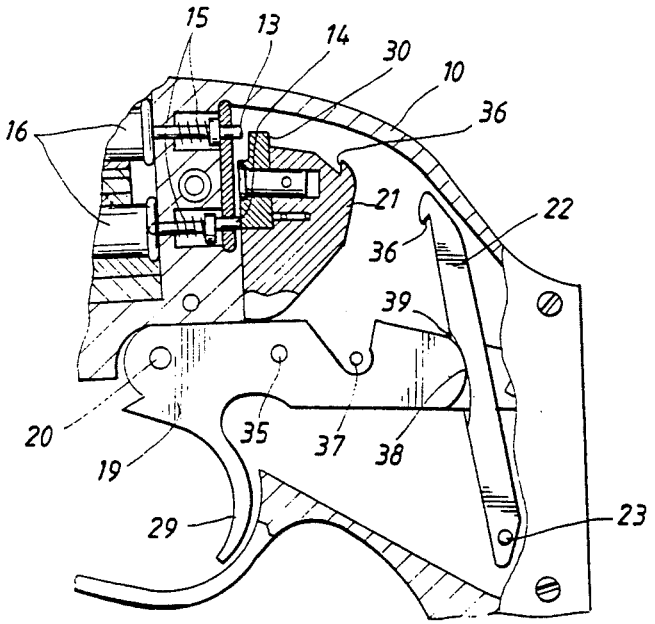
FIG. 3 schematically shows the firearm lock system of the present invention in the "just fired" position.

Referring now to FIG. 3, trigger plate 19 is shown in its most elevated position obtained when trigger lever 29 is in its rearmost position. In this position cam surfaces 38 and 39 have interacted to cause sear 22 to pivot about axis 23 until hammer sear engaging surfaces or interface 36 on each of these elements have completely disengaged releasing the hammer 21. The hammer 21, propelled by compressed hammer spring 25 (FIG. 1), has been propelled forward until the striking disk 30 front surface has engaged the lower firing pin 14 propelling the pin 14 forward to fire cartridqe 16 in the lower barrel 11.

Referring now to FIGS. 4, 5 and 6 the motion of the striking disk 30 about its axis of rotation 30A is shown in more detail. The front surface of the striking disk 30 is provided with three raised surfaces and three recessed surfaces in the manner shown. The recessed surfaces are of sufficient depth to prevent that portion of the front face of striking disk 30 from contacting one of the firing pins 13 or 14 when that recessed portion is in alignment with that particular firing pin. On the other hand the raised portions of the front face of striking disk 30 will contact the firing pins 13 and 14 when the hammer 21 is in its forward position as shown in FIG. 3. Thus in FIG. 4 lower firing pin 14 has been contacted by a striking disk 30 elevated portion. In FIG. 5 which corresponds to the trigger plate position shown in FIG. 2 the hand or pawl 31 has started rotating firing disk 30 from the position of FIG. 4 in a counter clockwise rotation by lifting upwardly on the toothed rear surface of disk 30. Finally in FIG. 6 the hammer 21 has returned to the fired position and the raised position of disk 30 front face has engaged upper barrel firing pin 13, while a recessed portion of disk 30 front face aligns with lower firing pin 14.

Now referring to FIG. 7 another important safety feature of the lock mechanism of the present invention is shown schematically in side view with the cover plate removed from frame 10. A key 41 is used in a lock 40 to impart a rotary motion to a rotatably mounted shaft 42 carried in a bore by the frame member 10. A hook engaging surface 43 is thus rotated into and out of engagement with a corresponding hook surface at the rear end of trigger plate 19. As the trigger plate 19 is spring biased toward the position shown in FIGS. 1 and 7 by a plunger spring arrangement 33 as shown in FIG. 2, when the key 41 is rotated appropriately hook surfaces 43 engage and lock trigger plate 19 and hence the entire lock mechanism into a totally immobile position as shown in FIG. 7. Thus only a person supplied with a key 41 can, by inserting the key in lock 40, rotate shaft 42 disengaging hook surface 43 and rendering the firing mechanism capable of motion.

Referring now to FIGS. 8, 9 and 10 the operation of a manual safety which is additionally provided will be described. The opening in the side of frame member 10 (FIG. 1) which allows access to the lock mechanism is covered by a side plate member 50 shown in FIG. 9. In addition to covering this opening and maintaining horizontal alignment of the component parts held to frame member 10 by pivot pins, the side plate 50 provides a mount for a rotatably mounted manual safety member 51 shown in FIGS. 9 and 10.

In FIG. 8 it will be noted that the trigger plate member 19 is rotatably mounted on pivot pin 20. The trigger plate 19 is provided on its facing surface with a safety notch 45 along with previously discussed safety notch 43. An engaging surface 46 (FIG. 10B) is provided on a safety member 51 for engaging the notch 45 in the trigger plate member 19 when the side plate 50 is secured in place. External safety lever 52 allows the safety member 51 to be rotated between two stops, a safe position where engaging surface 46 engages manual safety notch 45, and locks trigger plate 19 and a fire position where safety notch 45 is disengaged allowing pivotal motion of the trigger plate member 19.

It will be appreciated by those skilled in the art that the foregoing descriptions may make other embodiments accordingly to the concepts of the invention apparent. It is, according the aim of the appended claims to cover all such changes and modifications within the true spirit and scope of the invention.

I claim:

1. A double action lock apparatus for use with two barrel firearms for separately firing a first and a second barrel, comprising:

a frame member having a pair of barrels pivotally mounted thereon and having a pair of firing pin members aligned with the bores of said barrels in said barrels closed position;

a trigger plate member having a trigger lever and, pivotally mounted on said frame member and having at least one camming surface thereon;

a sear member pivotally mounted on said frame member and having a camming surface thereon capable of engaging said trigger plate member camming surface; and a hammer member pivotally mounted on said trigger plate member and having an engaging surface for engaging a corresponding engaging surface on said sear member, whereby pivotal motion of said trigger plate member about its axis of rotation causes cocking of said hammer member until said camming surfaces engagement causes pivotal motion of said sear member thereby disengaging said hammer sear engaging surfaces and releasing said hammer, allowing said hammer to strike said firing pin members.

2. The apparatus of claim 1 and further including means for selectively allowing said hammer to hit only one of said firing pin members at a time.

3. The apparatus of claim 2 wherein said means for selectively allowing includes rotatably mounted striker means on said hammer member.

4. The apparatus of claim 3 wherein said rotatably mounted striker means includes an indented front face and a toothed rear face.

5. The apparatus of claim 1 and further including pawl means rotatably mounted on said trigger plate for activating said means for selectively allowing said hammer to hit only one of said firing pins.

6. The apparatus of claim 1 wherein said frame member includes at least one surface for interrupting forward motion of said hammer prior to said hammer attaining a fully cocked position.

7. The apparatus of claim 1 wherein pivotal motion of said trigger plate about its axis of rotation causes a generally lifting motion of said hammer means relative to said frame member.

8. The apparatus of claim 7 wherein said frame member has an upper and a lower portion defined by upper and lower edges thereof and a centerline and wherein said trigger plate member and said sear member axes of rotation are both located in said lower portion.

9. The apparatus of claim 8 wherein the axis of rotation of said sear member is located nearer said lower edge of said frame member than the axis of rotation of said trigger plate member.

10. The apparatus of claim 9 and further including key operated safety means for rendering said trigger plate member selectively mobile or immobile.

11. The apparatus of claim 1 and further including a side plate member for covering said trigger plate member, said sear member and said hammer member and maintaining each of said members in horizontal alignment.

12. The apparatus of claim 11 wherein said trigger plate member is provided with a manual safety notch which is capable of engaging a safety member pivotally mounted on said side plate member.

13. The apparatus of claim 12 wherein said safety member is rotatable between a fire position and a safe position.

* * * * *